United States Patent [19]

Casstevens et al.

[11] Patent Number: 4,522,042

[45] Date of Patent: Jun. 11, 1985

[54] YARN CUTTING AND CLAMPING APPARATUS FOR CIRCULAR KNITTING MACHINES

[75] Inventors: Arvil Casstevens, Kernersville; William H. Coble; Harper Shields, both of Burlington; Roscoe M. Ferrell, Pittsboro; Bobby R. Jordan, Burlington, all of N.C.

[73] Assignee: Kayser-Roth Hosiery, Inc., Burlington, N.C.

[21] Appl. No.: 514,511

[22] Filed: Jul. 18, 1983

[51] Int. Cl.[3] ..... D04B 15/61

[52] U.S. Cl. ..... 66/140 S

[58] Field of Search ..... 66/134, 140 R, 140 S, 66/145 R, 145 S

[56] References Cited

U.S. PATENT DOCUMENTS

| | | | |
|---|---|---|---|
| 1,689,681 | 10/1928 | Pigeon | 66/134 X |
| 1,775,333 | 9/1930 | Trudel et al. | 66/134 X |
| 2,702,462 | 2/1955 | Green | 66/140 R |
| 2,893,229 | 7/1959 | Haddad | 66/145 R |
| 3,367,146 | 2/1968 | Allred | 66/140 S X |
| 3,392,550 | 7/1968 | Fontaine | 66/140 R |

FOREIGN PATENT DOCUMENTS

| | | | |
|---|---|---|---|
| 1900722 | 8/1970 | Fed. Rep. of Germany | 66/140 S |
| 696450 | 10/1965 | Italy | 66/140 S |

*Primary Examiner*—Wm. Carter Reynolds

*Attorney, Agent, or Firm*—Bell, Seltzer, Park & Gibson

[57] ABSTRACT

Both the leading and trailing ends of the respective yarns introduced to and removed from active knitting position are of uniform length on the inside of the sock when forming solid color patterned areas in the sock. The cutting of all yarn ends inside of the sock, enables the operator to easily evert and inspect the inside of the socks as they are removed from the knitting machine and eliminates the usual time consuming operation of cutting the yarn ends after the sock is knit. The cutting and clamping apparatus is illustrated in association with a four-feed solid color patterned knitting machine of the type normally employed in knitting argyle patterns in socks, and includes a vertically disposed suction tube with the lower end disposed within the upper end of the needle circle. A yarn clamping member is associated with the lower end of the suction tube and a hot wire cutter is positioned between the needle circle and the clamping member. A yarn lifting member is supported for vertical movement adjacent to clamping member and lifts a yarn moved to inactive position into engagement with the hot wire cutter.

17 Claims, 11 Drawing Figures

YARN CUTTING AND CLAMPING APPARATUS FOR CIRCULAR KNITTING MACHINES

FIELD OF THE INVENTION

This invention relates generally to a yarn cutting and clamping apparatus for circular knitting machines and more particularly to such an apparatus for multi-feed circular hosiery knitting machines of the type adapted to knit socks with argyle-type solid color patterns and overplaid patterns.

BACKGROUND OF THE INVENTION

In "solid color pattern" knitting machines, it is the usual practice to continuously feed both the active and inactive pattern yarns throughout the knitting cycle of each sock. These continuously fed pattern yarns extend in a twisted cordlike yarn bundle throughout each sock and from one sock to the next sock. The twisted cord bundle must be cut between the socks as they are removed from the knitting machine and the yarn ends inside of each stocking must be cut to remove the twisted together pattern yarns. In some cases, the yarns forming the cord may become entangled or pulled and produce faulty knitting, thereby resulting in defective socks. Also, the yarn loss resulting from the interconnection and the continuous feeding of the pattern yarns is very costly while the time consumed in the cutting of the yarn ends is very significant.

It has been recognized that it would be advantageous to be able to reduce the yarn waste by cutting and clamping the pattern yarns at certain areas during the knitting cycle. For example, U.S. Pat. Nos. 2,893,229 and 3,016,725 disclose cutting and clamping devices particularly adapted for use with Banner Model SCP and SCOP machines in which two diametrically opposed yarn feeding and knitting stations are provided. However, the cutting and clamping devices of these two patents are adapted to operate only one time during the knitting of each sock, that is, upon completion of the knitting of the pattern in the leg of the sock so that the cordlike bundle of pattern yarns does not extend through the rotary knit foot portion. This results in some yarn savings but does not provide for the individual cutting and clamping of each pattern yarn as it is moved into and out of active yarn feeding position during the knitting of the pattern in the leg.

U.S. Pat. Nos. 2,924,958 and 3,271,979 disclose yarn cutting and clamping devices particularly adapted for use with a solid color pattern hosiery knitting machine of the type manufactured by Textile Machine Works and known as a CKA machine which is provided with four spaced-apart yarn feeding and knitting stations. These patents disclose the use of a more or less conventional scissors type of yarn cutting and clamping device positioned adjacent each yarn feeding and knitting station. The individual yarn cutting and clamping devices are operated by solenoids in U.S. Pat. No. 2,924,958 while they are operated by a separate control pattern drum in U.S. Pat. No. 3,271,979. The cutting devices of these two patents are expensive to install on the knitting machine and occasionally permit one of the clamped multiple yarns to be released from the clamping device and cause the formation of a defective sock. Because of the deficiencies of these prior types of known cutters and clamps for this particular type of solid color hosiery knitting machine, none of the prior devices have been widely used on this type of knitting machine.

SUMMARY OF THE INVENTION

With the foregoing in mind, it is an object of the present invention to provide a yarn cutting and clamping apparatus for multi-feed solid color pattern hosiery knitting machines which cuts the pattern yarns with free ends of uniform length as they are moved to inactive position and maintains the free ends of the inactive pattern yarns in a positive manner. The present yarn cutting and clamping apparatus is easily applied to existing solid color pattern hosiery knitting machines and is extremely efficient in operation.

All of the parts of the present yarn cutting and clamping apparatus are mounted on and supported by a single cross support bar which may be quickly and easily attached to the solid color pattern knitting machine. The present cutting and clamping apparatus is actuated by an air cylinder which is operated in timed relationship to operation of the movement of the yarn feeding fingers between active and inactive positions.

The yarn clamping and cutting apparatus of the present invention includes at least one vertically disposed suction tube with its lower end disposed within the needle circle and a clamping member is operatively associated with the lower end of the suction tube. A hot wire type yarn cutter is positioned between the needle circle and the clamping member. A yarn guide wire extends within the needle circle and inwardly of and below the level of the yarn feeding position when the yarn is in active knitting position. The yarn guide wire normally maintains the yarn below the level of the hot wire yarn cutter when the pattern yarn is moved to inactive positions. A yarn lifting member is supported for vertical movement adjacent the clamping member and is operatively associated therewith. Control means is operable in response to movement of a yarn feed finger out of active knitting position for lowering the yarn lifting member below the level of the yarn guide wire and for lifting the yarn into engagement with the hot wire yarn cutter and in close proximity to the lower free end of the suction tube so that the cut free end of the inactive pattern yarn will be drawn into the suction tube and the clamping member associated therewith.

BRIEF DESCRIPTION OF THE DRAWINGS

Other objects and advantages will appear as the description proceeds when taken in connection with the accompanying drawings, in which.

DESCRIPTION OF THE ILLUSTRATED EMBODIMENT

Figure 1:
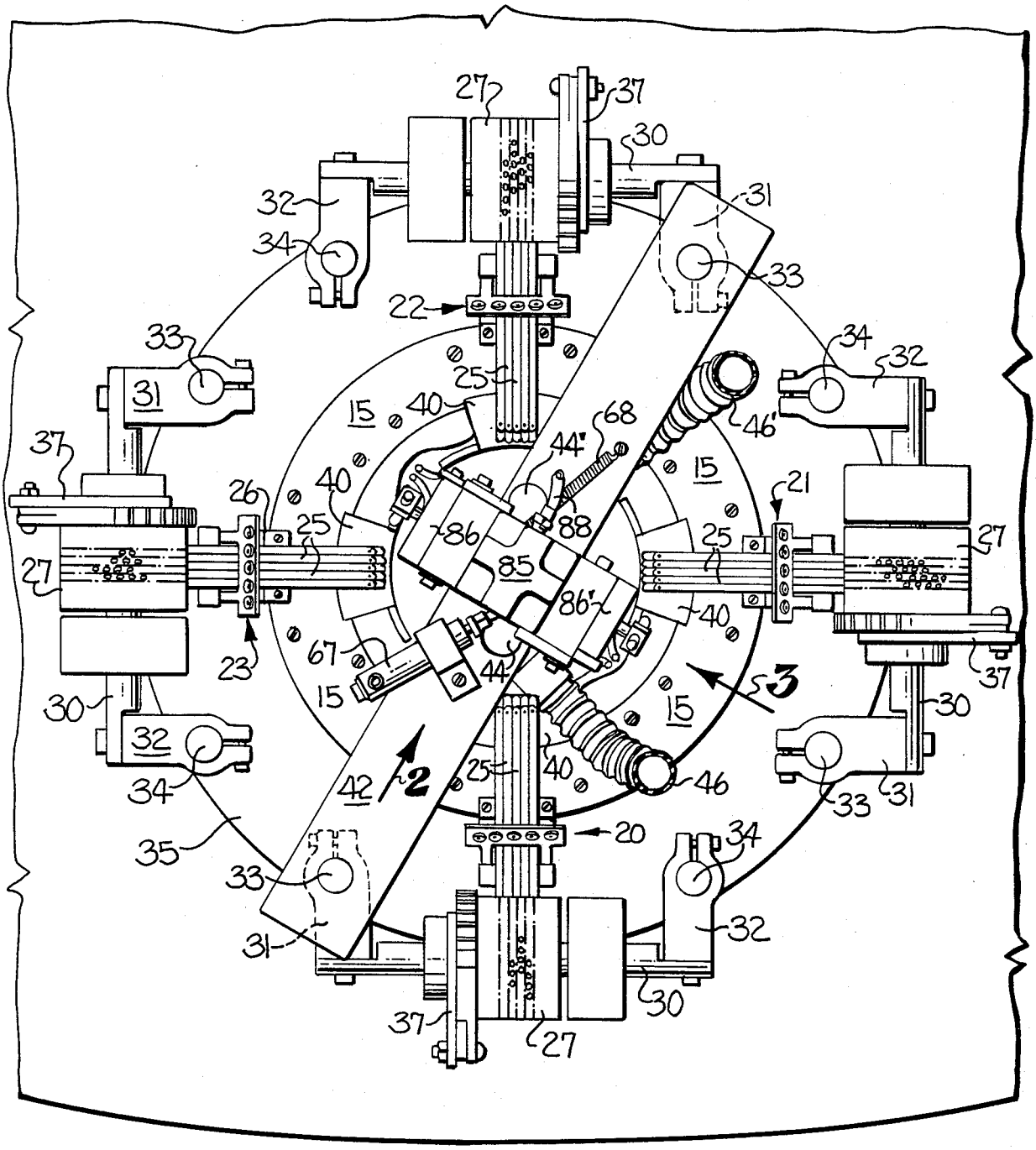
FIG. 1 is a fragmentary plan view of a four feed solid color pattern knitting machine and with the present cutting and clamping apparatus associated therewith.

The cutting and clamping apparatus of the present invention is illustrated in association with a four feed solid color pattern hosiery knitting machine of the type manufactured by Textile Machine Works and known as the CKA machine. The various parts of this machine are illustrated in detail in U.S. Pat. No. 3,136,145 and the disclosure of this patent is incorporated by reference into the present application for a description and disclosure of the conventional parts of the machine which are not disclosed in the present application. It is believed that a sufficient disclosure of the machine is shown in the present invention to enable one skilled in the art to understand the operation of the cutting and clamping apparatus when applied to this type of machine. However, it is to be understood that the present cutting and clamping device is not limited to use with this particular machine but is also applicable to other types of circular hosiery knitting machines.

The machine includes a vertically slotted needle cylinder 10 which is driven for selective rotary and reciprocating motion and a circle of needles 11 is supported for vertical movement in the slots of the needle cylinder 10. Sinkers or web holders 12 are supported for horizontal sliding movement between the needles and in radial slots in a sinker support bed or ring 13 secured to the upper end portion of the needle cylinder 10. A sinker cap 14 is supported in a fixed position around the sinker ring 13 and supports a sinker cam ring 15 including suitable cams for operating the sinkers 12 in a radial direction to cooperate with the needles 11 and form stitch loops. The usual stitch cams, not shown, are provided at each of the four yarn feeding and knitting stations radially spaced around the needle cylinder and indicated broadly at 20–23. Since each of the four yarn feeding and knitting stations 20–23 is identical, the corresponding parts of each yarn feeding and knitting station are indicated with like reference characters.

Yarns are fed to the needles 11 through yarn feed fingers 25, five of which are shown at each of the feeding stations. The medial portions of the yarn feed fingers 25 are pivotally mounted for movement so that their inner ends move between a lowered or active position in which the yarns are taken by the needles and knit into stitch loops and a raised or inactive position in which the yarns are out of action, these two positions of the inner ends of the fingers 25 being illustrated in FIGS. 8–11. The fingers 25 at each of the feeding stations are supported for pivotal movement in yarn guide blocks 26 secured to the cam ring 15. The outer ends of the fingers 25 are engaged and operated between the active and inactive positions by a button drum 27 rotatably carried on a shaft 30. Opposite ends of the shaft 30 are secured to arms 31, 32 which are in turn supported for vertical adjustment on upright studs 33, 34 secured at their lower ends in an upper bed plate 35. The button drum 27 is rotated in a step-by-step manner by an associated pawl and ratchet device 37 mounted on the shaft 30. The pawl and ratchet device 37 is selectively operable by connections with the main pattern drum, not shown, of the machine.

The yarn fingers 25 operate between the active and inactive positions in a throat plate 40 supported on the cam ring 15 when knitting solid color argyle socks on the present machine, with or without an overplaid yarn extending through the argyle patterns. Normally, all of the yarns forming the solid color pattern areas and the overplaid pattern are continuously fed through the yarn feed fingers 25, regardless of whether they are in active or inactive position, and the inactive yarns form a twisted cordlike yarn bundle extending throughout the center of the sock. In contrast to this normal operation, the cutting and clamping device of the present invention is operable in response to movement of the yarn feed fingers into and out of active knitting position to cut each of the yarn ends as they are removed from active knitting position. The withdrawn yarns are cut with free ends of the same length and the free ends of the inactive yarns are held or clamped until they are again moved to active knitting position.

The yarn cutting and clamping means of the present invention is illustrated as including a pair of identical cutting and clamping devices. In the present instance, the first of the yarn cutting and clamping devices is adapted to cut and clamp the yarns fed at two adjacent yarn feeding and knitting stations, for example, the fourth feeding station 23 and the first feeding station 20, while the second cutting and clamping device is adapted to cut and clamp the yarns fed at the second and third knitting and yarn feeding stations 21, 22. However, it is to be understood that the present yarn cutting and clamping means could include only a single yarn cutting and clamping device, particularly when used on a two-feed solid color pattern knitting machine, or when only two of the knitting stations of the machine are being used.

The present yarn cutting and clamping means includes a single mounting and cross support bar 42 extending transversely across and above the upper portion of the knitting machine and having opposite end portions supported for vertical adjustment on the upper portions of the upright posts 33 adjacent the respective yarn feeding stations 20 and 22 (FIG. 1). The first and second cutting and clamping devices include respective vertically disposed suction tubes 44, 44' with their upper ends being adjustably supported in bores in the cross support bar 42 and the lower ends thereof are provided with corresponding elliptical housings 45, 45' having open rectangular inner faces.

Flexible corrugated yarn removal suction pipes 46, 46' are connected to an intermediate portion of the respective suction tubes 44, 44' and their other ends are provided with thread collection traps, not shown, for collecting the yarn ends withdrawn therethrough, in a manner to be presently described. The lower ends of compressed air lines 47, 47' extend through the lower portions of the walls of the suction tubes 44, 44' and direct compressed air upwardly so that air is drawn inwardly through the open faces of the corresponding housings 45, 45', thereby creating suction currents in the tubes 44, 44'.

Figure 6:
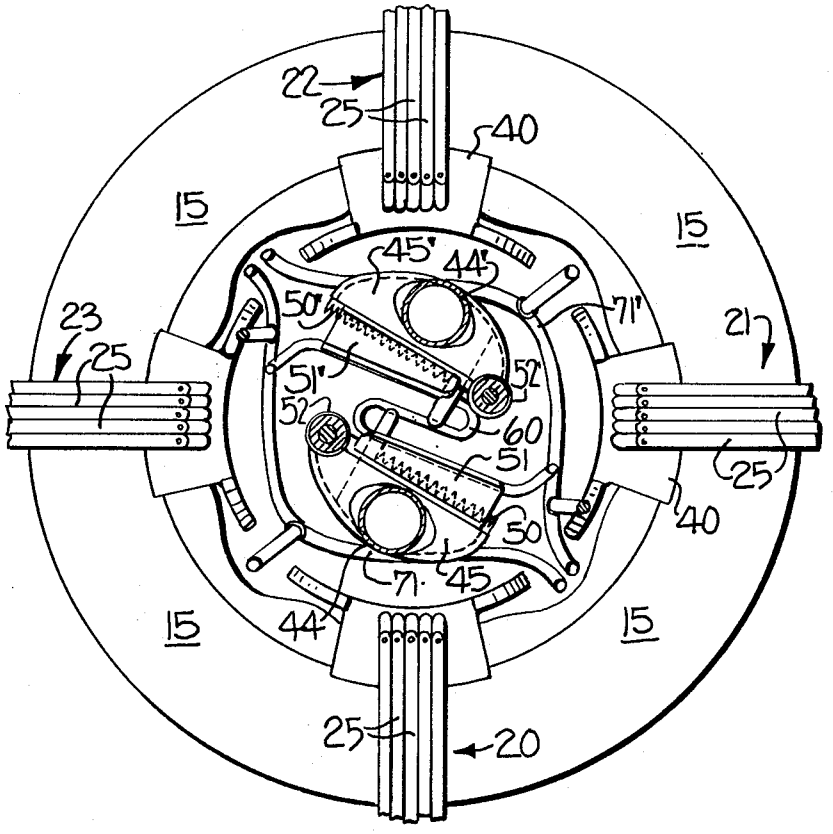

Respective yarn gripping plates 50, 50' form a part of clamping means associated with the lower ends of each of the suction tubes 44, 44' and each of the plates 50, 50' includes a serrated free edge extending outwardly slightly beyond the open face of the suction housings 45, 45'. Clamping cam plate gate members 51, 51' are pivotally supported for swinging movement at one end on the respective housings 45, 45'. Respective torsion springs 52, 52' normally urge the yarn clamping gate members 51, 51' inwardly into position above the plates 50, 50' and against the lower edge of the rectangular open inner edge of the suction housings 45, 45', as shown in FIG. 6, to normally clamp any yarn ends extending upwardly into the suction housings 45, 45'. The yarn clamping cam plate gate members 51, 51' are provided with angularly extending wing portions which extend upwardly and outwardly and provide cam surfaces, for purposes to be presently described.

A yarn cutter, in the form of a hot wire 60 is positioned between the yarn clamping gate members 51, 51' (FIG. 6) and has a generally Z-shaped configuration with opposite ends thereof extending upwardly and being supported in insulation blocks 61, 61'. The hot wire 60 is formed of a length of electrical resistance wire which is connected at opposite ends to an electrical circuit that is completed to cause the hot wire 60 to reach a sufficient temperature to sever yarns brought in contact therewith. The insulation blocks 61, 61' are fixed on the lower ends of vertical support arms 62, 62' which extend upwardly and have their upper ends secured at the opposite ends of a rocker support arm 63.

Figure 5:
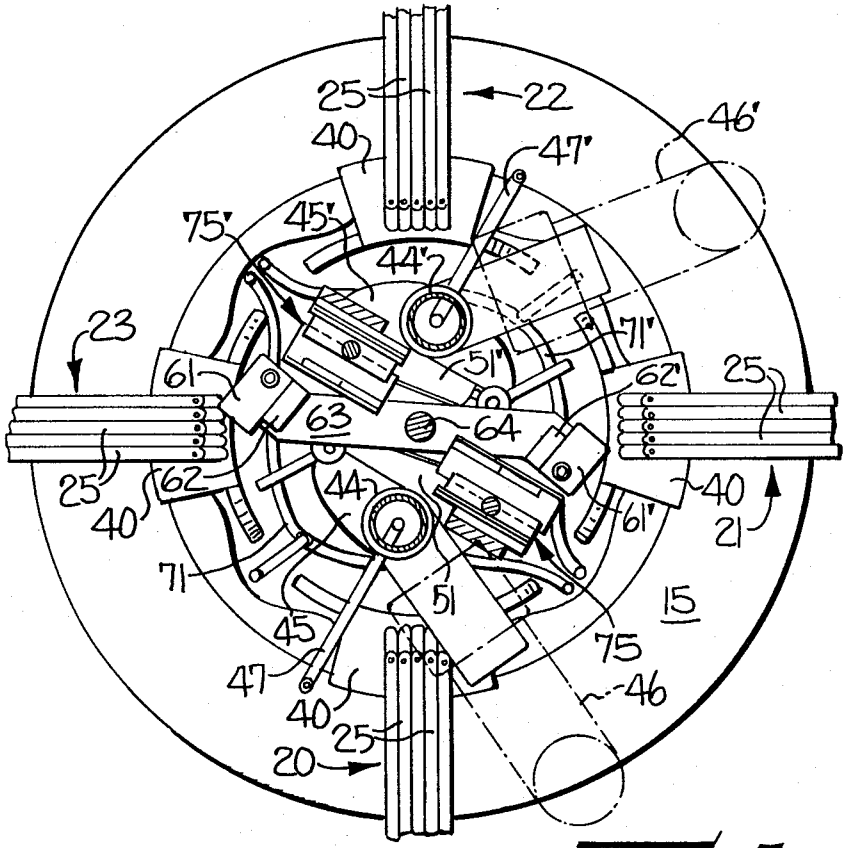
FIGS. 4, 5 and 6 are horizontal sectional views taken along the respective section lines in FIG. 2.
Figure 4:
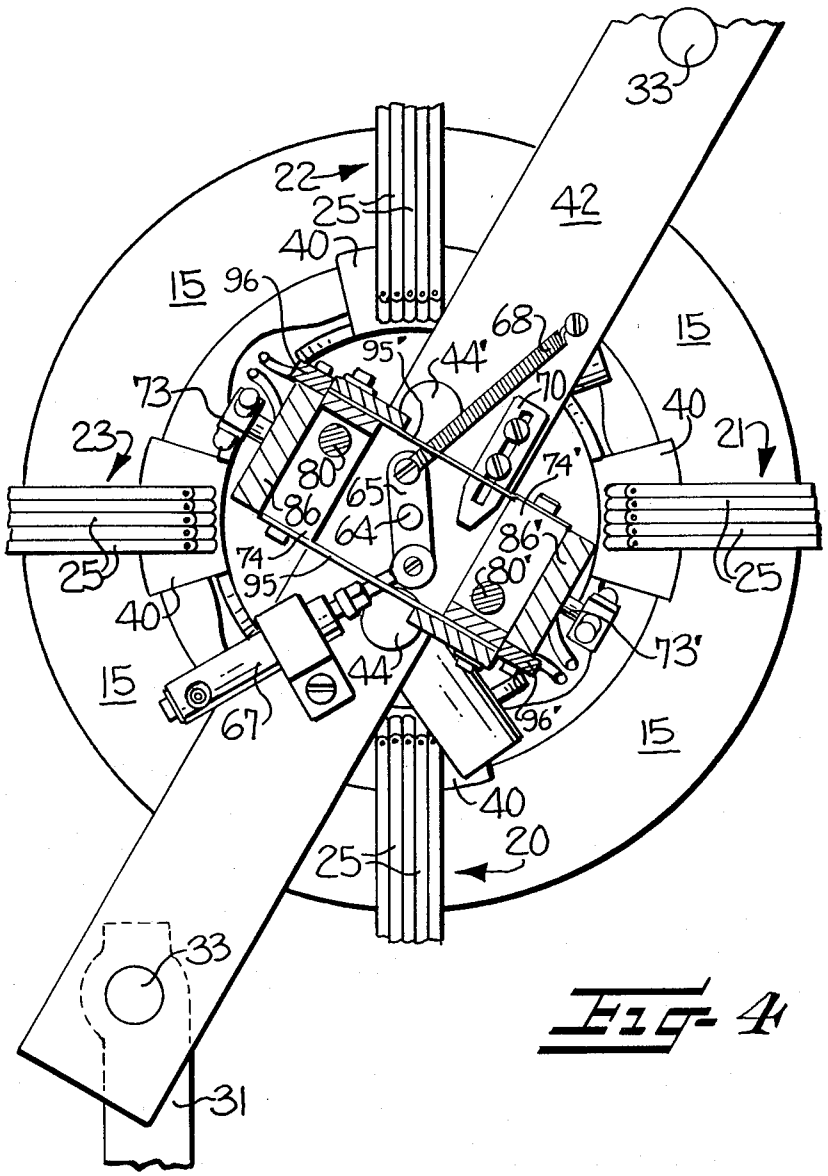

The rocker support arm 63 is fixed intermediate its ends on the lower end of a pivot shaft 64 which extends upwardly through and is supported for limited rotation in the cross support bar 42 (FIGS. 4 and 5). An operator rocker arm 65 is fixed to the upper end of the pivot shaft 64 and is connected at one end to the piston rod of an air cylinder 67. The rocker arm 65 is normally urged in a clockwise direction in FIG. 4 by a tension spring 68 so that the heated wire cutter 60 is maintained in the position shown in FIG. 6 during normal operation. When a yarn is to be cut, the air cylinder 67 is operated to move the rocker arm 65 in a counterclockwise direction in FIG. 4 and against an adjustable stop member 70 so that the hot wire 60 is moved away from the corresponding suction housings 45, 45'.

Figure 2:
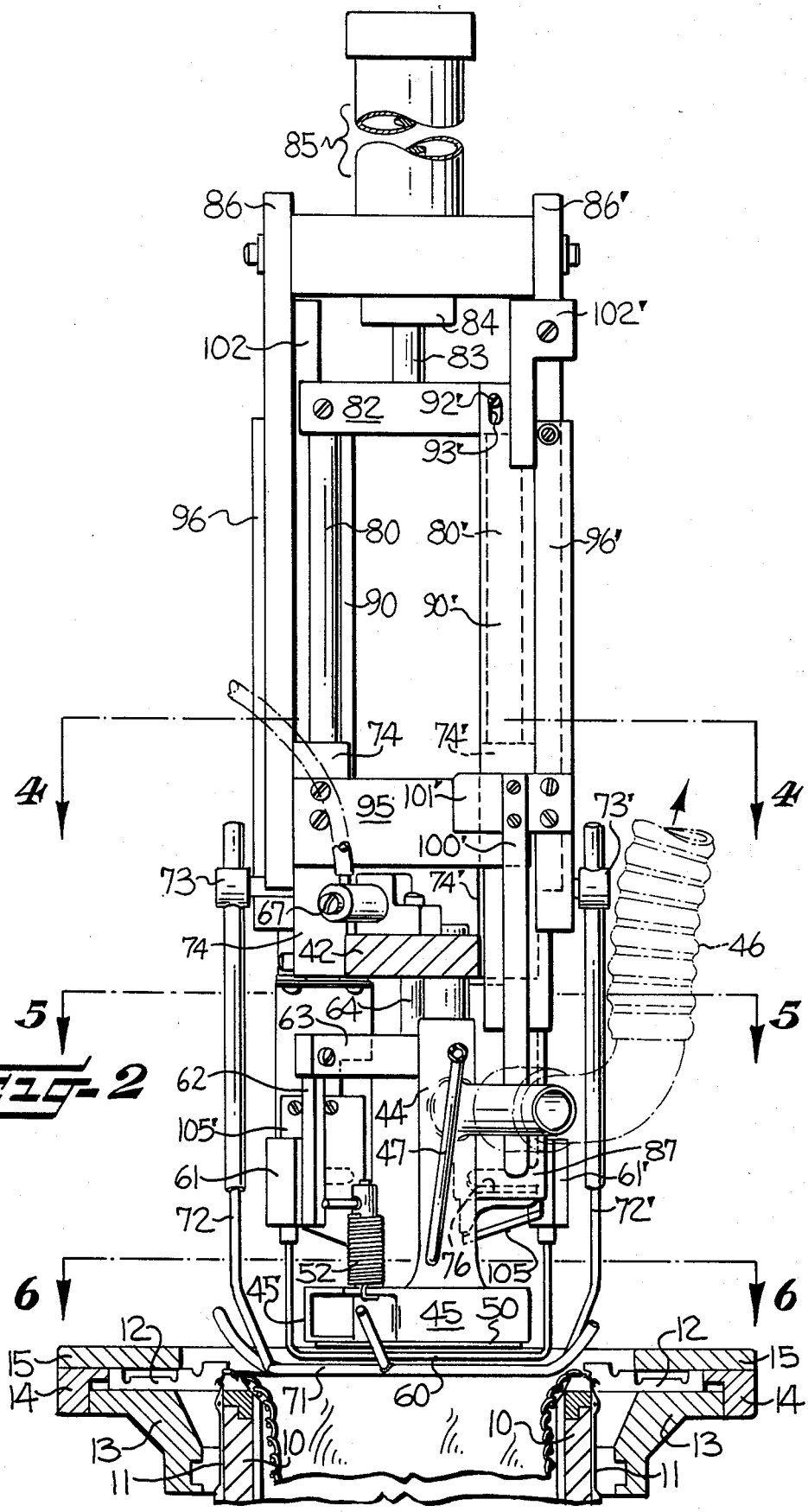
FIG. 2 is a front elevational view of the cutting and clamping apparatus looking in the direction of the arrow 2 in FIG. 1 and showing the upper end of the needle cylinder in cross section.
Figure 7:
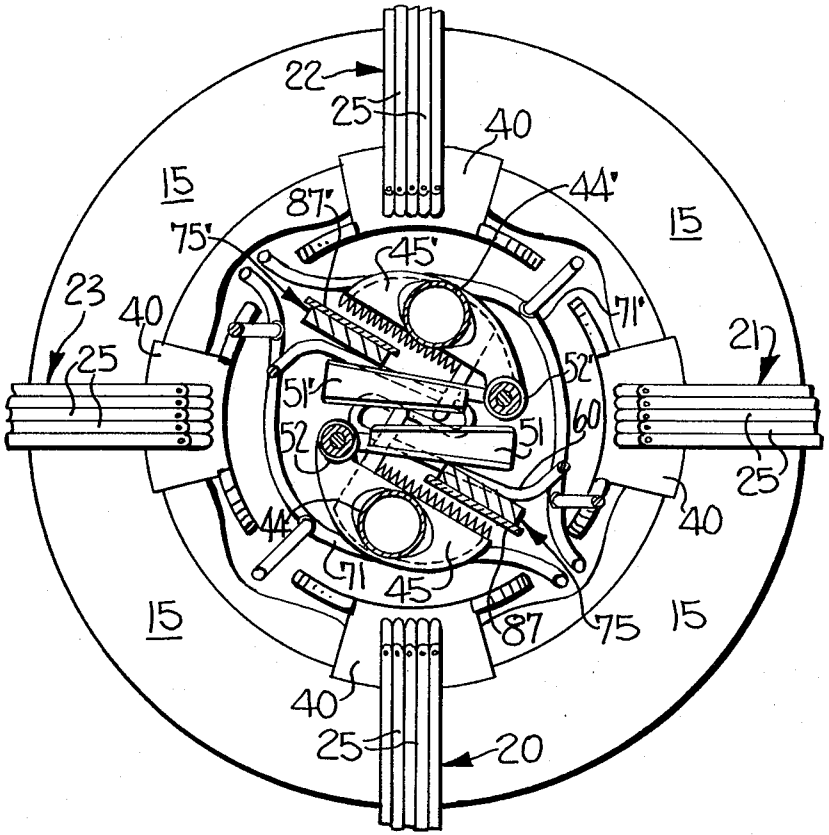
FIG. 7 is a view similar to FIG. 6 but showing the yarn lifting elements being lowered to open the yarn clamps associated with the lower ends of the suction tubes.

Yarn guide wire means, illustrated in FIGS. 6 and 7 as elliptically curving wires 71, 71', extends within the needle circle and inwardly of and below the level of the yarn feeding positions, when the yarn feed fingers 25 are in active position in engagement with the corresponding throat plates 40, as illustrated in FIGS. 8–11. The wires 71, 71' are supported between the needle circle and the hot wire cutters 60, 60' and are fixed to the lower ends of support posts 72, 72' (FIG. 2), the upper ends of which are adjustably fixed in studs 73, 73' carried by vertical support blocks 74, 74' the lower ends of which are fixed on opposite sides of the support bar 42.

Figure 3:
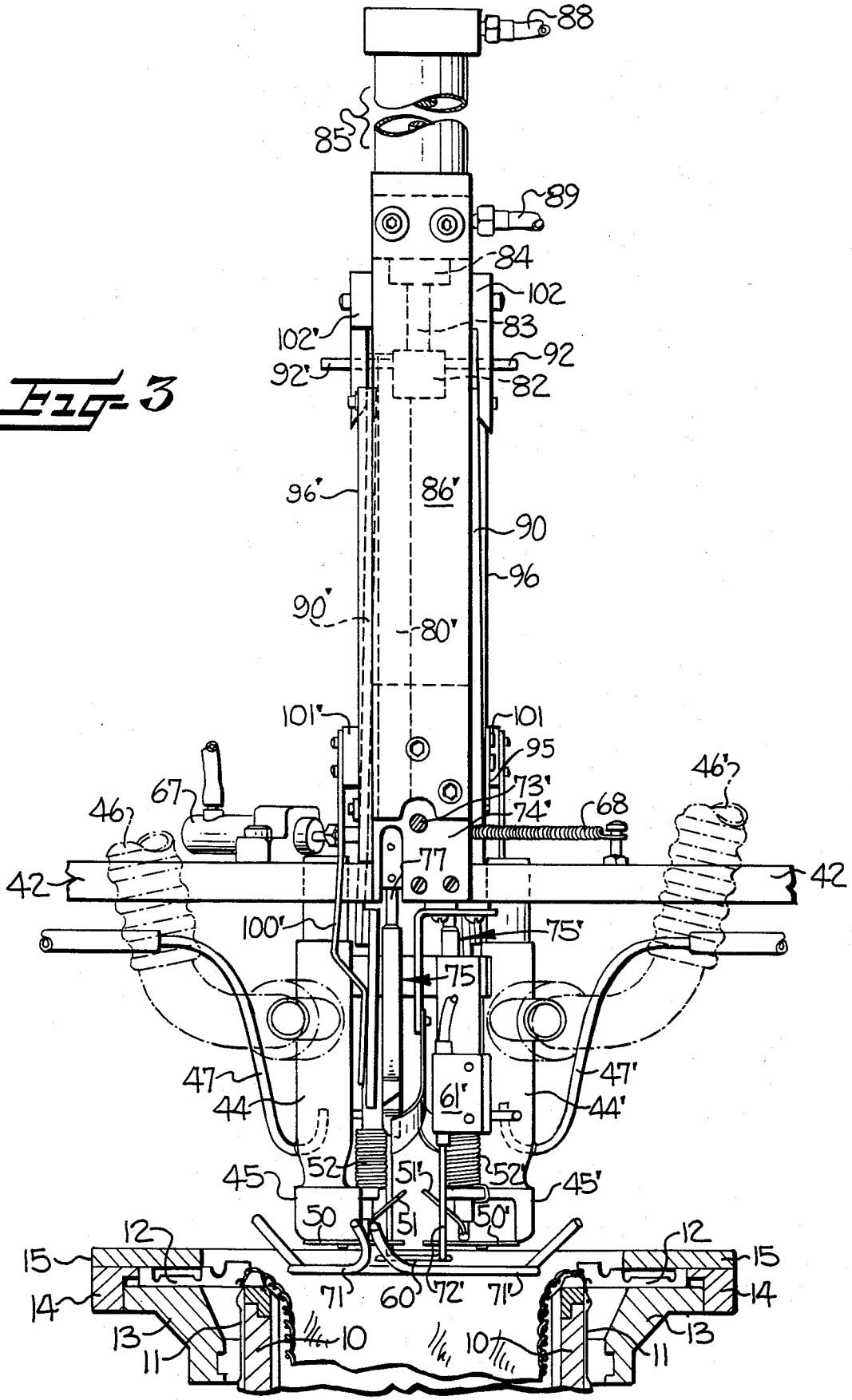
FIG. 3 is a view similar to FIG. 2 but looking at one side of the cutting and clamping apparatus and in the direction of the arrow 3 in FIG. 1.

Yarn lifting members, broadly indicated at 75, 75' (FIG. 8) are supported for vertical movement adjacent the clamping members 51, 51' and are operatively associated therewith. The yarn lifting members 75, 75' are in the form of flat plates with a horizontally extending yarn receiving slot 76 extending inwardly from one side thereof (FIGS. 8–11) and the upper ends are fixed to the lower ends of rods 77, 77' which are in turn adjustably supported in the lower ends of vertically extending operator rods 80, 80'. As shown in FIG. 3 the U-shaped cutout in block 74' is provided to facilitate access to a pair of set screws in the lower end of the operator rod 80' to allow vertical adjustment of the upper end of the rod 77 on the upper end of the lifting member 75. The operator rods 80, 80' are supported for vertical sliding movement in vertical bores in the support blocks 74, 74' and their upper ends are connected to opposed end portions of a cross bar 82.

The medial portion of the cross bar 82 is fixed to the lower end of a piston rod 83 which is provided with an adjustable stop member 84 and the upper portion of the piston rod 83 extends into an air cylinder 85. The air cylinder 85 is supported in a vertical position on the upper ends of vertical support plates 86, 86', the lower ends of which are fixed on the outer surfaces of the support blocks 74, 74'. Suitable air hose connections 88, 89 (FIG. 3) are provided on the air cylinder 85 for lowering and raising the clamping members 75, 75' between the raised position shown in FIG. 3 and the lowered position shown in FIGS. 8 and 9, and vice versa, for purposes to be presently described.

Figure 9:
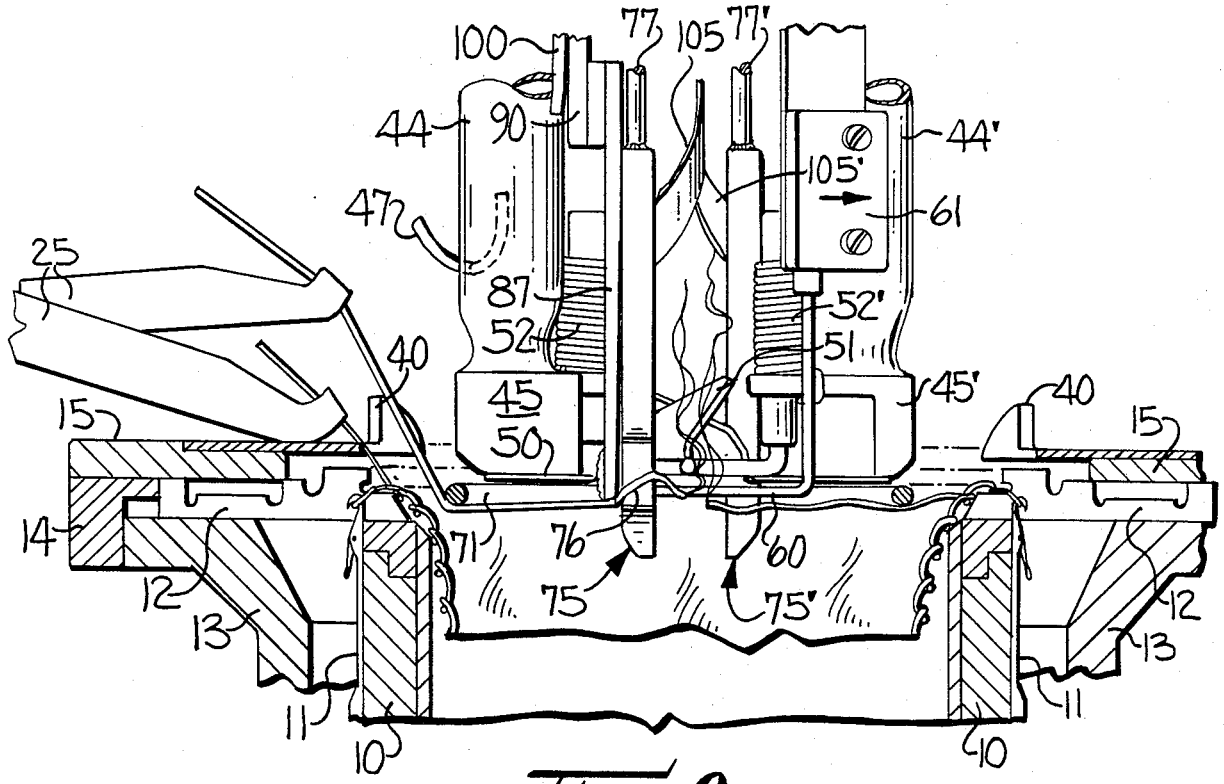
Figure 11:
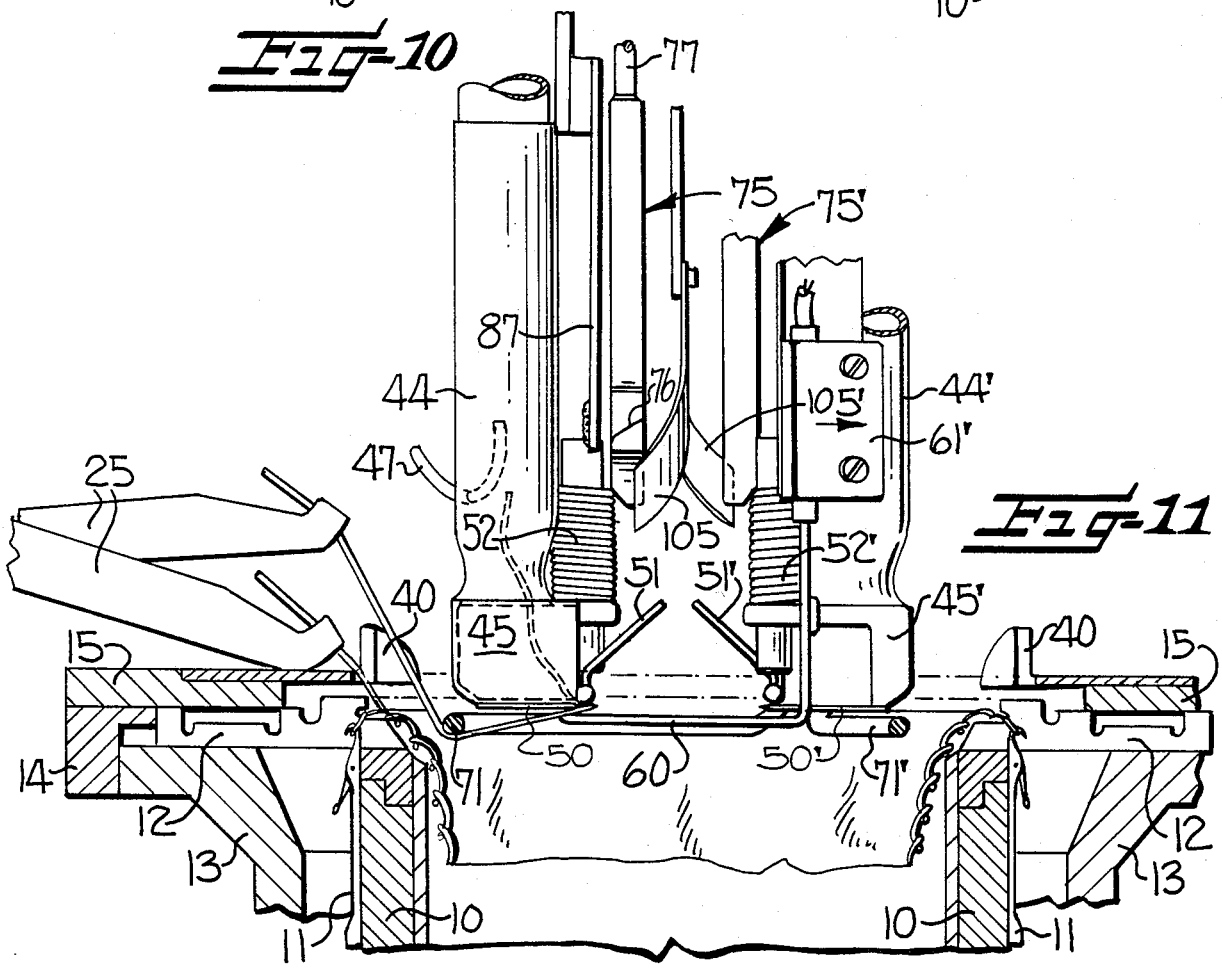

The lower ends of auxiliary clamping plates 87, 87' slideably engage the surfaces of the respective clamping members 75, 75' adjacent the corresponding suction housing 45, 45'. The clamping plates 87, 87' are adapted to move into yarn clamping position, as shown in FIG. 9 when the yarn lifting members 75, 75' are being raised and to release the yarn ends when the yarn clamping members 75, 75' have been raised, as shown in FIG. 11. The auxiliary yarn clamping plates 87, 87' are fixed at their upper ends to the lower ends of control slide plates 90, 90' which extend upwardly therefrom.

The upper ends of the slide plates 90, 90' are operatively connected to the cross bar 82 by means of respective operator pins 92, 92' which extend through elongated slots 93, 93' in the slide plates 90, 90'. Leaf spring guide members 95, 95' are connected at one end to the respective support blocks 74, 74' and their opposite ends slideably engage the outer surfaces of the respective slide plates 90, 90' to resiliently maintain their outer surfaces against the support blocks 74, 74'.

Leaf spring members 100, 100' are fixed at their upper ends on extension plates 101, 101' and their lower ends normally urge the auxiliary clamping plates 87, 87' into clamping relationship with the lifting members 75, 75'. Cam plates 102, 102' are fixed on the surfaces of the respective support bars 86, 86' and overlie the path of vertical movement of the upper ends of the slide plates 90, 90'. When the slide plates 90, 90' and the auxiliary clamping plates 87, 87' are lowered, along with the yarn lifting elements 75, 75', the upper ends of the control plates 90, 90' move away from beneath the cam plates 102, 102' so that the auxiliary clamping plate 87 is maintained in resilient engagement with the clamping members 75, 75' by means of the leaf springs 100, 100'. On the other hand, when the slide plates 90, 90' are raised upwardly, by the pins 92, 92', so that their upper ends engage and are moved inwardly by the cam members 102, 102', the upper ends of the slide plates 90, 90' are pivoted or rocked inwardly axially of the pins 92, 92' so that the lower ends are pivoted or rocked outwardly against the support blanks 74, 74'; along with the auxiliary clamping plates 87, 87'. This rocking action on the support blocks 74, 74' causes the auxiliary clamping plates 87, 87' to move away from the yarn lifting members 75, 75' and release the yarn held thereby, as illustrated in FIG. 11.

Figure 10:
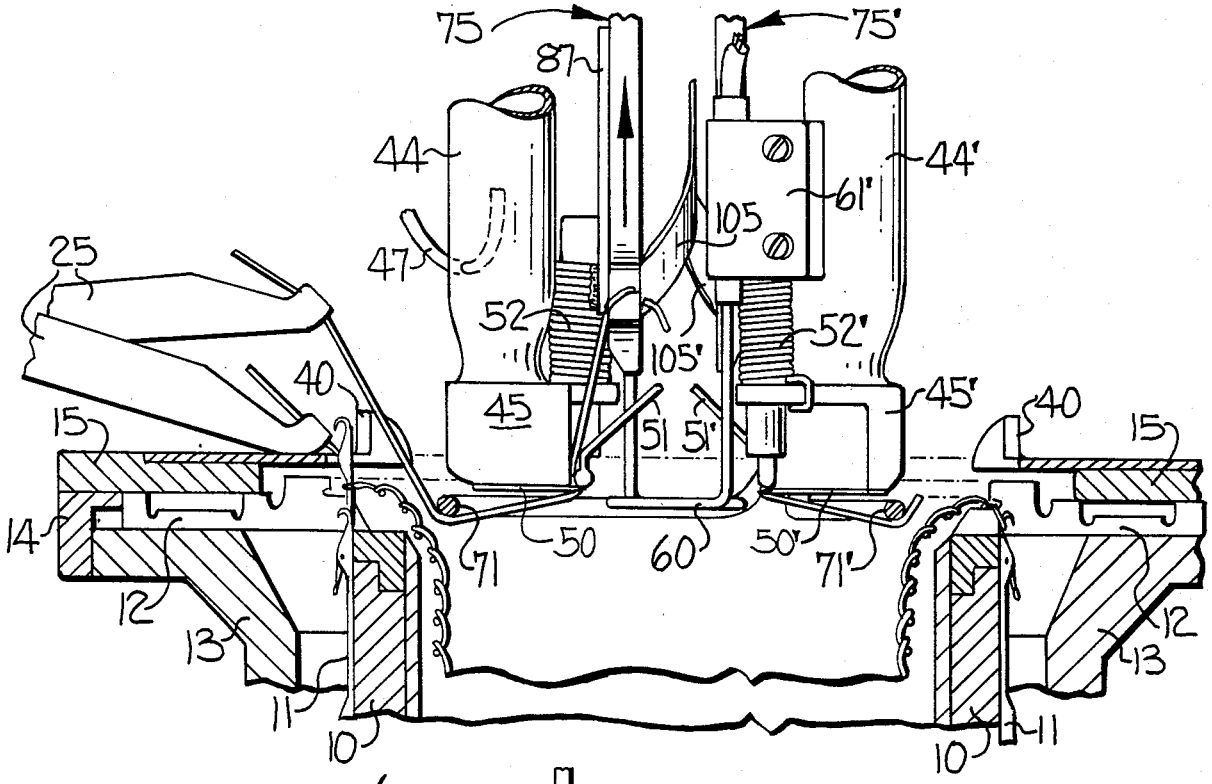

Auxiliary yarn cutting plates 105, 105' are supported at their upper ends on the cross bar 42 and their lower ends are resiliently maintained against the inner surfaces of the yarn lifting members 75, 75' (FIGS. 3 and 8–11). As the associated yarn lifting members 75, 75' are raised, as shown in FIG. 10, the cutting plates 105, 105' resiliently bear against the inner surfaces of the lifting members 75, 75' to cut the free end of the yarn carried upwardly thereby.

Method of Operation

When the needle cylinder is reciprocating and knitting solid color patterns in the sock, with or without an overplaid pattern, the parts of the yarn clamping and cutting apparatus of the present invention are in substantially the position shown in FIG. 11, with the withdrawn yarns extending from the inactive yarn fingers 25 at each of the yarn knitting stations 20–23, beneath the respective guide wires 71, 71', and upwardly with their free ends being positioned in the suction housings 45, 45' and with the clamping gates 51, 51' holding the yarn ends therein. The pattern yarns extending from the active yarn feed fingers 25 at each of the knitting stations are being fed directly to the needles 11 and forming solid color knit fabric.

Figure 8:
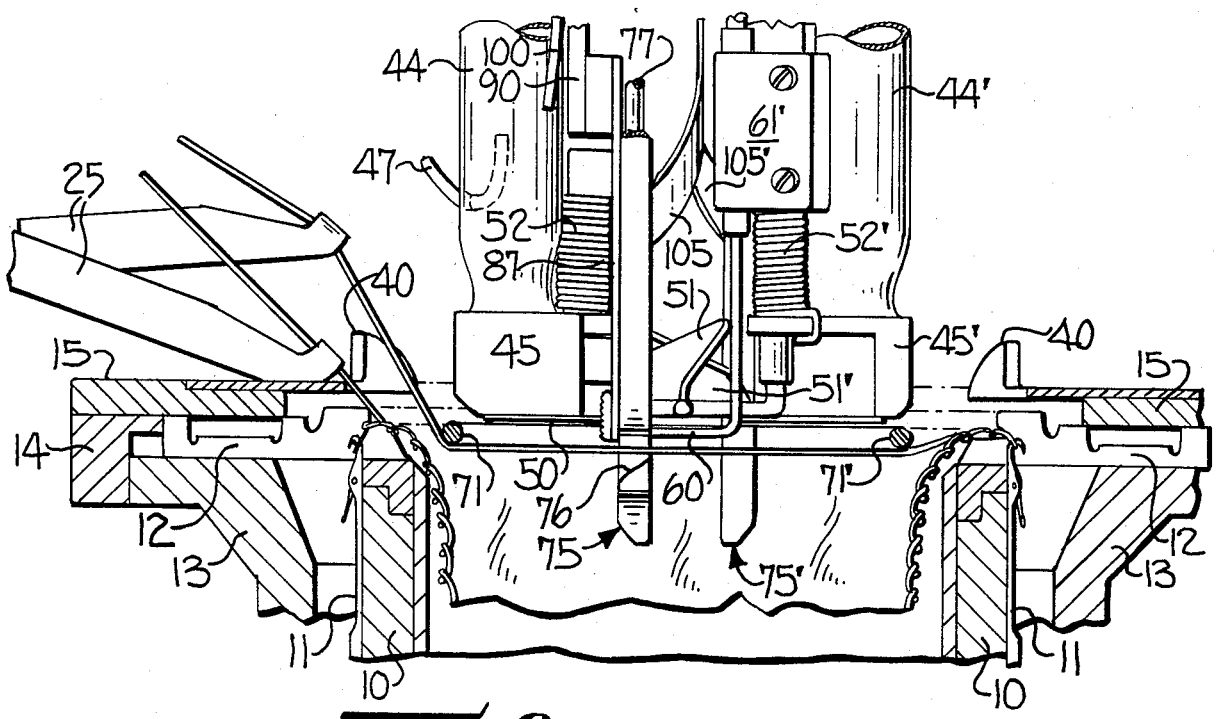
FIGS. 8 through 11 are fragmentary vertical sectional views illustrating the manner in which the cutting and clamping apparatus operates when a pattern yarn is moved to the inactive position.

When a yarn feed finger 25 is moved from the inactive position to the active position, usually followed immediately by the movement of a yarn feed finger 25 from active to inactive position, the operation of the feed fingers 25 actuates valve control means, not shown, for operating operator means, in the form of air cylinders 67 and 85 to move the hot wire 60 in a counterclockwise direction and for lowering the yarn lifting members 75, 75', respectively, to the position shown in FIG. 8. As the inactive yarn is carried around the cylinder by the fabric, this inactive yarn moves into one of the yarn receiving slots 76, 76' in one of the lifting members 75, 75'. The lowering of the lifting members 75, 75' is carried out by directing air pressure through the air hose 88 so that air pressure enters the upper end of the air cylinder 85. At the same time, the auxiliary yarn clamping plates 87, 87' are moved downwardly to the position shown in FIG. 8.

Air is then directed into the lower air pressure line 89 to cause the piston rod 83 of the air cylinder 85 to begin to raise the yarn lifting members 75, 75', as illustrated in FIG. 9. The elongate slots 93, 93' permit the yarn lifting members 75, 75' to be raised before the auxiliary clamping plates 87, 87' are raised so that lower end of the auxiliary clamping plate 87 engages and clamps the yarn on the side of the yarn lifting member 75 adjacent the suction housing 45. The yarn on the other side of the lifting member 75 is raised upwardly into engagement with the hot wire 60 to sever the yarn extending from the last knit stitch of the fabric to the hot wire 60, as shown in FIG. 9.

As the yarn lifting member 75 is additionally raised, as shown in FIG. 10, the lower end of the yarn lifting member 75 moves out of engagement with the gate clamp 51 so that it swings closed against the yarn. The short length of yarn extending beyond the inner face of the yarn lifting member 75 is cut by the auxiliary leaf spring cutter blade 105. Since suction currents are entering the suction housing 45, the short cut free end is drawn into the housing 45 and withdrawn by the suction tube 44. With further raising of the yarn lifting member 75, as shown in FIG. 11, the lower end of the auxiliary clamping plate 87 is rocked outwardly and out of clamping engagement with the outer face of the yarn lifting member 75. Upon release of the yarn, the free end of the inactive yarn is drawn up into the suction housing 45 and suction tube 44. The inactive or withdrawn yarn is held in this position by the clamping gate 51 until it is again moved to active knitting position.

When an inactive yarn feed finger 25 is moved downwardly to active yarn feeding position, the needles pick up the yarn and start forming stitch loops while the free end of the yarn is held by the clamping gate 51. After a few stitch loops have been formed, the yarn lifting member 75 is lowered and the lower end engages the cam wing surface of the gate clamp 51 to open the same so that the free end of the yarn is released and forms a free length of yarn on the inner surface of the knit sock. This free length of yarn is of uniform length with the free ends of all other yarns on the inside of the sock. When the yarn lifting member 75 is in the lowered position, it is in position to receive yarns which have been moved from the lower active position to the raised inactive position so that these inactive yarns are cut and clamped as the yarn lifting member 75 is raised, in the same manner as previously described.

Thus, the present yarn cutting and clamping apparatus operates in response to movement of the yarn feed fingers 25 between active and inactive knitting positions to lower the yarn lifting members 75, 75' so that the trailing ends of the yarns removed from active position are uniformly cut and held or clamped. Also, the yarns moved into active knitting position have their leading free ends released from the gate clamps 51, 51' so that the leading ends are of uniform length. Therefore, all yarn ends, both the leading and trailing ends, are of uniform length on the inside of the sock and an operator can easily evert and inspect the inside of the socks as they are removed from the knitting machine. The entire yarn cutting and clamping apparatus of the present invention is supported on the cross support bar 42 which may be easily attached to and removed from the upright posts 33, already present on the knitting machine.

In the drawings and specification there has been set forth the best mode presently contemplated for the practice of the present invention, and although specific terms are employed, they are used in a generic and descriptive sense only and not for purposes of limitation, the scope of the invention being defined in the claims.

That which is claimed is:

1. In a circular knitting machine including a needle cylinder, a circle of needles carried by said needle cylinder, a plurality of yarn feeding stations positioned in spaced-apart relationship around said needle circle, each yarn feeding station having a plurality of yarn feed fingers individually movable between active and inactive positions, and means for knitting yarn fed by said yarn feeding fingers into adjacent solid color fabric pattern areas of different yarn, the combination therewith of means for cutting and clamping yarns moved into and out of active knitting position by said yarn feed fingers, said yarn cutting and clamping means comprising a vertically disposed suction tube having a lower end disposed within said needle circle, a clamping member associated with said lower end of said suction tube, a yarn cutter positioned between said needle circle and said clamping member, guide wire means extending within the needle circle and inwardly of and below the level of the yarn feeding position when the yarn is in active knitting position, a yarn lifting member supported for vertical movement adjacent said clamping member and operatively associated therewith, and operator means operable in response to movement of a yarn feed finger out of active knitting position for lowering said yarn lifting member below the level of said guide wire means and to engage a yarn moved to inactive position and for lifting the same into engagement with said yarn cutter and in close proximity to the lower free end of said suction tube so that the inactive yarn is cut and the free cut end of the inactive yarn is drawn into said suction tube and held by said clamping member associated therewith.

2. In a circular knitting machine according to claim 1 wherein said operator means is further operable in response to movement of a yarn feed finger into active knitting position for lowering said yarn lifting member into engagement with said clamping member to release the free end of the yarn being held thereby.

3. In a circular knitting machine according to claim 1 wherein said yarn cutter comprises an electrical resistance wire.

4. In a circular knitting machine according to claim 3 wherein said electrical resistance wire yarn cutter is positioned adjacent the vertical path of travel of said yarn lifting member, and including means supporting said electrical resistance wire yarn cutter for selective movement toward and away from said clamping member.

5. In a circular knitting machine according to claim 1 wherein said clamping member comprises a gate-type clamping member supported for pivotal movement at one end adjacent the lower end of said suction tube and being swingable between clamped and unclamped positions.

6. In a circular knitting machine according to claim 1 including auxiliary yarn clamping means operatively associated with said yarn lifting member and being movable into clamping engagement with a yarn engaged by said yarn lifting member, and said auxiliary yarn clamping means being operable to clamp the yarn after said yarn lifting member has been raised a sufficient distance to bring the yarn into engagement with said yarn cutter.

7. In a circular knitting machine including a needle cylinder, four yarn feeding stations positioned in spaced-apart relationship around said needle cylinder, each yarn feeding station including a plurality of yarn feed fingers individually movable between active and inactive positions, and means for knitting yarn fed by said yarn feeding fingers into adjacent solid color fabric pattern areas of different yarns, the combination therewith of means for cutting and clamping the yarns moved into and out of active knitting position by said yarn feed fingers, said yarn cutting and clamping means comprising a pair of vertically disposed suction tubes having lower ends disposed within and on opposed sides of said needle cylinder, a clamping member associated with the lower end of each of said suction tubes, a yarn cutter positioned between said suction tubes, guide wire means extending within said needle cylinder and inwardly of and below the level of the yarn feeding position when the yarn is in active knitting position, a yarn lifting member supported for vertical movement adjacent each of said clamping members and operatively associated therewith, and operator means operable in response to movement of a yarn feed finger out of active knitting position for lowering both of said yarn lifting members below the level of said guide wire means to engage the yarn moved to inactive position and for lifting the same into engagement with said yarn cutter and in close proximity to the lower free end of a corresponding suction tube so that the inactive yarn is cut and the free cut end of the inactive yarn is drawn into said corresponding suction tube and held by said clamping member associated therewith.

8. In a circular knitting machine according to claim 7 including an upright post extending upwardly on each of opposite sides of said needle cylinder and extending upwardly beyond the upper level thereof, and wherein said yarn cutting and clamping means includes a cross support bar having opposite ends supported on said upright posts, and wherein all of said operating parts of said yarn cutting and clamping means are supported on said cross support bar so that said yarn cutting and clamping means can be easily removed from and replaced on said knitting machine.

9. In a circular knitting machine according to claim 8 wherein each of said yarn lifting members comprises a plate including a transverse yarn engaging and receiving slot adjacent the lower end thereof and a support rod extending upwardly from the upper end thereof, a support block fixed to said cross support bar, an operator rod supported for vertical movement in said support block and being adjustably connected to said support rod of said yarn lifting member, and wherein said operator means is connected to the upper end of said operator rod for imparting vertical movement thereto in timed relationship to movement of a yarn feed finger between active and inactive knitting positions.

10. In a circular knitting machine according to claim 9 wherein said operator means for imparting vertical movement to said operator rod includes an air cylinder supported above said operator rod and operatively connected to the upper end of said operator rod.

11. In a circular knitting machine according to claim 10 including a crossbar having opposite ends fixed to the upper ends of each of said operator rods, and wherein said air cylinder is operatively connected to the medial portion of said crossbar to simultaneously impart vertical movement to said operator rods.

12. In a circular knitting machine according to claim 7 wherein the lower ends of each of said suction tubes is provided with a corresponding elliptical suction housing having an open rectangular inner face, and wherein said clamping member is adapted to move into and out of engagement with the lower edge of said open rectangular face of said suction housing.

13. In a circular knitting machine according to claim 12 including a yarn gripping plate fixed to the lower surface of said suction housing and including a serrated free edge extending outwardly slightly beyond the open face of said suction housing for cooperating with said clamping member in holding yarn therebetween.

14. In a circular knitting machine according to claim 7 including auxiliary yarn clamping means operatively associated with each of said yarn lifting members and being movable into clamping engagement with a yarn engaged by said yarn lifting member, and said auxiliary yarn clamping means being operable to clamp the yarn after the corresponding yarn lifting member has been raised a sufficient distance to bring the yarn into engagement with said yarn cutter.

15. In a circular knitting machine according to claim 7 wherein said yarn cutter comprises an electrical resistance wire.

16. In a circular knitting machine according to claim 15 wherein said electrical resistance wire yarn cutter is positioned between the lower ends of said suction tubes.

17. In a circular knitting machine according to claim 16 including means supporting said electrical resistance wire yarn cutter for selective movement toward and away from the corresponding suction tubes and the respective associated clamping members.

* * * * *